United States Patent [19]

Höffken

[11] Patent Number: 4,962,808

[45] Date of Patent: Oct. 16, 1990

[54] METHOD OF PRODUCING A STEEL STRIP HAVING A THICKNESS OF LESS THAN 10 MM

[75] Inventor: Erich Höffken, Dinslaken, Fed. Rep. of Germany

[73] Assignee: Thyssen Stahl Aktiegesellschaft, Duisburg, Fed. Rep. of Germany

[21] Appl. No.: 376,341

[22] Filed: Jul. 6, 1989

[30] Foreign Application Priority Data

Jul. 14, 1988 [DE] Fed. Rep. of Germany ..... 3823861
May 8, 1989 [EP] European Pat. Off. ..... 89108232.3

[51] Int. Cl.[5] ..... B22D 11/00
[52] U.S. Cl. ..... 164/476; 148/2
[58] Field of Search ..... 164/476, 477; 148/2

[56] References Cited

U.S. PATENT DOCUMENTS 3,491,823 1/1970 Tarmann et al. ..... 164/476

FOREIGN PATENT DOCUMENTS 61-189850 8/1986 Japan ..... 164/476
62-192241 8/1987 Japan ..... 164/476

*Primary Examiner*—Kuang Y. Lin
*Attorney, Agent, or Firm*—Sprung, Horn Kramer & Woods

[57] ABSTRACT

The invention relates to a method of producing a steel strip having a thickness of less than 10 mm by the casting of a steel strand in a cooled continuous ingot mould. After leaving the ingot mould and until the welding of the inner walls of the already solidified strand shell, the not yet thoroughly solidified steel strand is compressed, the thickness of the strand shell being reduced with a degree of deformation of >40%. FIG. 2 is intended for the Abstract.

7 Claims, 2 Drawing Sheets

METHOD OF PRODUCING A STEEL STRIP HAVING A THICKNESS OF LESS THAN 10 MM

Figure 1:
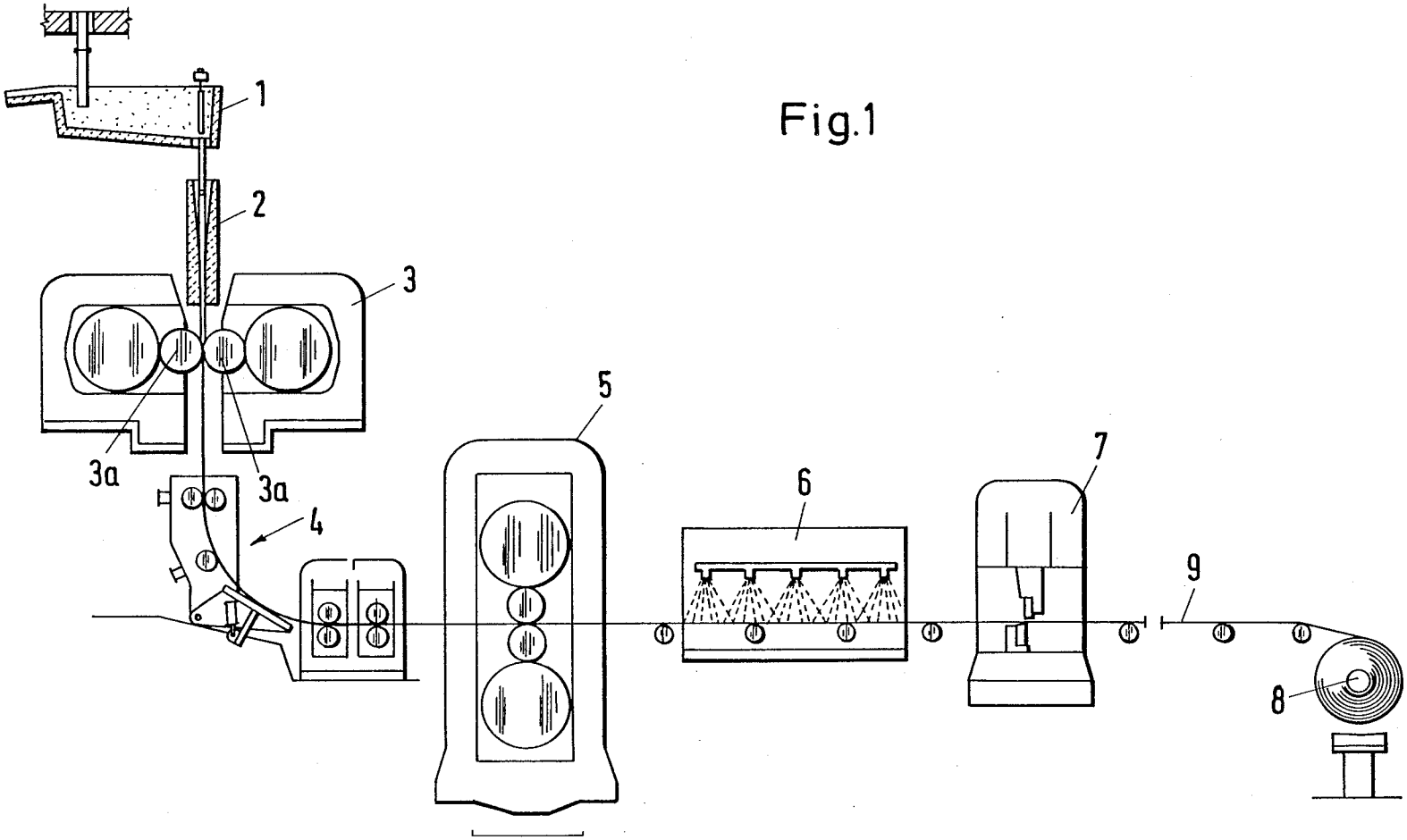

The invention relates to a process for the production of a steel strip having a thickness of less than 10 mm by the casting of a steel strand in a cooled continuous ingot mould, whereafter the not yet completely solidified steel strand withdrawn from the ingot mould is compressed up to the welding of the inner walls of the already solidified strand shell.

In a prior art method of the kind specified ("Patent Abstracts of Japan", Vol. 8, No. 210 (M-328) 1647, Sept. 26 1984; Japanese Patent Application A 5997747 (A)) the already solidified strand shells of the not yet completely solidified steel strand withdrawn from the ingot mould are compressed until the thickness of the strip is substantially equal to twice the thickness of the already solidified strand shell. To ensure reliable welding of the strand shells, according to this prior art method a pressure can be exerted on the strand shells such that the strand emerging from the pinch rolls is equal to the sum of the thicknesses of the two strand shells.

However, by this known step, which is applied in continuous casting to obtain strands free from piping, only strips having a thickness of 20–50 mm are achieved. For many uses such strips are too thick, since strips having a thickness of 20–50 mm cannot be reduced to the required minimum thickness of about 2 mm in conventional cold rolling mills.

For the production of thin strips, the preliminary strip produced in the conventional manner is cooled and, after complete solidification, subdivided into pieces of suitable length or wound into a coil. In preparation for the subsequent rolling out into thin strips, the coil is subjected to a heating treatment in an intermediate regenerative furnace and adjusted to a uniform temperature. The strip is rolled out in a number of passes. It is still very expensive to roll out thin strips, due to the need for the intermediate regenerative furnace and the large number of roll stands. A further disadvantage in such rolling out following the heating of the strip is that its surface scales, making satisfactory hot rolling difficult.

It is therefore an object of the invention to provide a method and an installation by means of which high quality steel strips having a thickness of 1–10 mm can be produced in a very simple manner.

This problem is solved in a method of the kind specified by the feature that the thickness of the solidified strand shells is reduced in the same operation as the compression of the cast strand with a degree of deformation of >40%. Such a reduction in thickness can be achieved with a roll stand, more particularly a horizontal drive four-high stand, disposed at the ingot mould outlet.

By the method according to the invention it is possible to produce in one operation from the not yet completely solidified steel strand withdrawn from the ingot mould a thin strip which, immediately after suitable cooling, can be wound into coils or further processed. The production of steel strips by the method according to the invention is extremely inexpensive, since no large energy-intensive installations are required with heating furnaces and roll stands.

According to the invention the different parameters in the casting of the steel strand on the one hand and the reduction in the thickness of the strand shells on the other are so harmonized with one another that the steel strand can be compressed without breaks and the strand shells can withstand considerable deformations during reduction in thickness. It has been found to be particularly advantageous if the casting speed and/or the cooling intensity of the ingot mould is so controlled that on withdrawal from the ingot mould the steel strand has a shell thickness of 5–10 mm. This ensures that the strand shell is strong enough to withstand the forces occuring during deformation without the formation of cracks.

It has been found to be convenient for a uniform deformation of the cast strand and a satisfactory structural formation if after the withdrawal of the cast strand from the continuous ingot mould the solidified strand shells are compressed at the highest possible temperatures. Satisfactory results are obtained if the surface temperature of the cast strand is higher than 1100° C., preferably being 1200° C. to 1400° C., more particularly 1300° C. It has proved advantageous for the strand shell to have perpendicularly to the strand surface a temperature gradient which is determined by the strand surface temperature and a temperature close to the solidus temperature in the interior of the cast strand. Since all qualities of steel are highly loadable at a temperature of more than 1200° C., cracks in the strand skin during deformation are prevented by the maintenance of the aforementioned temperatures.

Also advantageously for the formation of a particularly satisfactory structure of the rolled strip, the thickness of the strand shells is reduced during the compression of the cast strand with a degree of deformation of 50–80%. For many applications and/or with certain steel qualities, it may be advantageous to improve the surface texture by giving the strips an additional rerolling with a degree of deformation lower than 5%. At the same time the strip can also be given a contour.

According to one feature of the invention, a first reduction in the thickness of the cast strand is performed in the continuous ingot mould. To this end the strand shells forming on the wide sides of the continuous ingot mould are moved together, at least in the central zone, during the withdrawal of the cast strand by a suitable construction of a funnel-shaped zone of the continuous ingot mould. The cooling of the continuous ingot mould is so adjusted that the strand shells start to be formed in the funnel-shaped zone, so that a strand still having a molten core is formed at that place. It is important for the strand shell to be formed only with a thickness at which such moving together is still possible.

Figure 2:
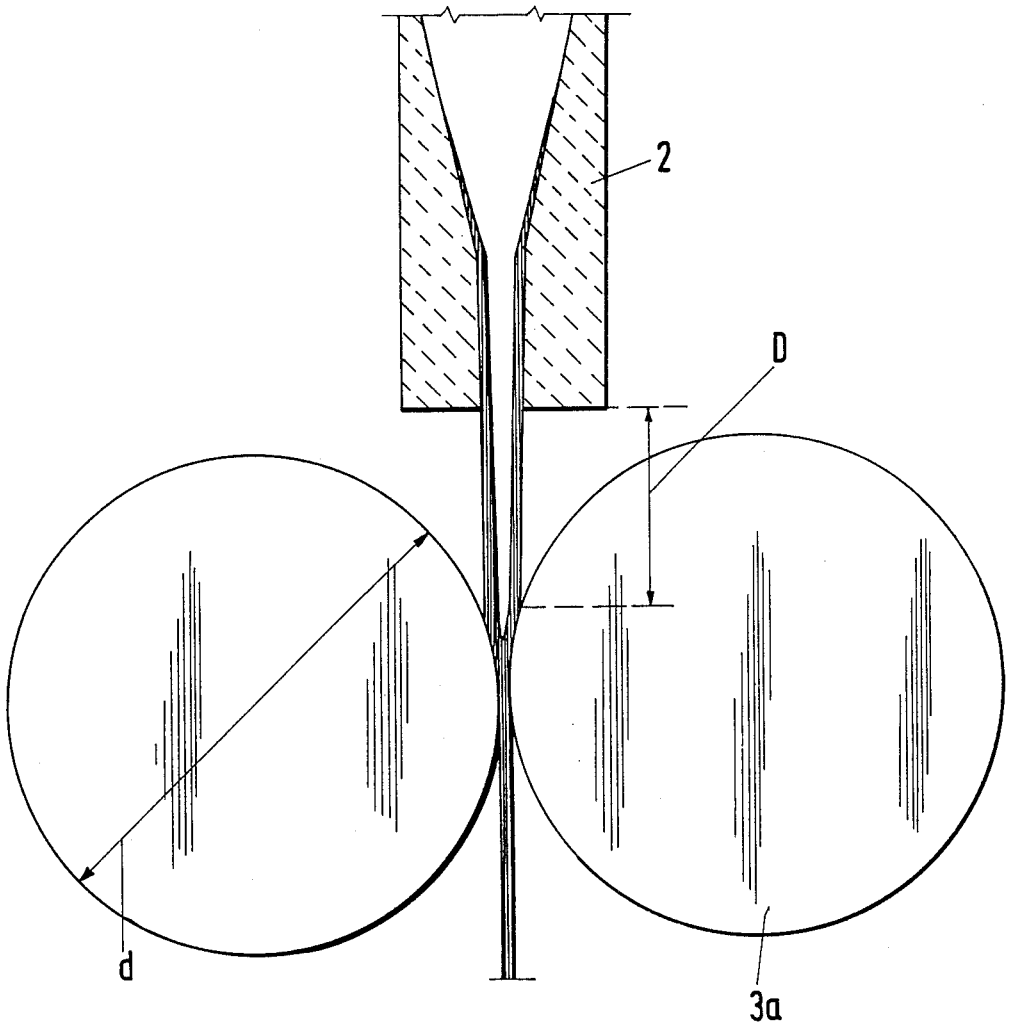

An embodiment of the invention in the form of an installation for the production of a steel strip will now be described in greater detail with reference to the accompanying diagrammatic drawings, wherein:

FIG. 1 is a side elevation of an installation for the performance of the method, and FIG. 2 shows a detail, to an enlarged scale in comparison with FIG. 1, the detail of the installation illustrated in FIG. 1 in the zone between the continuous casting ingot mould and the roll stand.

Molten steel flows out of a tundish 1 into an oscillating ingot mould 2, consisting of a funnel-shaped upper part and a lower part having parallel cooled walls, the distance of which corresponds to the thickness of the strand to be cast. Due to the funnel-shaped construction of the ingot mould, during the withdrawal of the cast strand the solidifying strand shells are moved together in the funnel-shaped zone, thus achieving a first reduction in the thickness of the cast strand. Disposed immediately at the ingot mould outlet is a roll stand 3 by which the solidified strand shells are pressed together, welded to one another and reduced in thickness. The roll stand is, for example, a horizontal four-high stand whose driven working rolls 3*a* for the compression and reduction in thickness of the strand 10 can be adjusted by means of hydraulic cylinders. Section-determining supporting rolls should be associated with the narrow sides in the zone of the working rolls 3*a*. The diameter d of the working rolls 3*a* should be between 0.5 and 1 m, while the distance D between the start of the zone of engagement and the bottom edge of the ingot mould 2 should be smaller than 0.5 m. These relations are shown in FIG. 2.

Disposed downstream of the roll stand 3 following a curved guide 4 there can be a roll stand 5 by which the fully solidified cast strand is dressed with a small degree of deformation of about 5%. Disposed downstream of the roll stand 5 are a cooling system 6, shears 7 and a reel 8 for the coiling of the strip 9.

I claim:

1. In the production of a steel strip having a thickness of less than 10 mm by the casting of a steel strand in a cooled continuous ingot mould, wherein a not-yet-completely solidified steel strand is withdrawn from the ingot mould and compressed up to the welding of the inner walls of the already solidified strand shell, the improvement which comprises reducing the thickness of the solidified strand shells in said compression step with a degree of deformation of >40%.

2. The method according to claim 1, wherein the thickness of the solidified strand shells is reduced together with the compression of the cast strand with a degree of deformation of 50–80%.

3. The method according to claim 1, wherein the strand shells solidifying on the wide sides of the continuous ingot mould are moved together by a funnel-shaped construction of the continuous ingot mould during the withdrawal of the cast strand therefrom, thereby to reduce the thickness of the cast strand.

4. The method according to claim 1, wherein the cooling of the continuous ingot mould is so effected that on withdrawal from the ingot mould and prior to compression, the cast strand has a surface temperature of 1100° to 1400° C.

5. The method according to claim 1, wherein the cooling of the continuous ingot mould is so effected that on withdrawal from the ingot mould and prior to compression, the cast strand has a surface temperature of 1300° C.

6. The method according to claim 1, wherein following compression the cast strand is rerolled with a degree of deformation of about 5%.

7. The method according to claim 6, wherein during rerolling the cast strand is contoured to a predetermined shape.

* * * * *